US005909194A

United States Patent [19]

Umeda et al.

[11] Patent Number: 5,909,194

[45] **Date of Patent: *Jun. 1, 1999**

[54] TELESCOPING, DUAL ANTENNA MOUNTED WITH FLEXIBLE BOOT

[75] Inventors: Koji Umeda, Saitama; Takao Ono, Tokyo, both of Japan

[73] Assignees: NEC Corporation; Anten Corporation, both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/838,065

[22] Filed: Apr. 18, 1997

Related U.S. Application Data

[63] Continuation of application No. 08/497,161, Jun. 30, 1995, abandoned.

[30] Foreign Application Priority Data

Jun. 16, 1995 [JP] Japan ..... 7-150481

[51] Int. Cl.[6] ..... H01Q 1/24

[52] U.S. Cl. ..... 343/702; 343/901

[58] Field of Search ..... 343/702, 900, 343/901, 903, 895; H01Q 1/24

[56] References Cited

U.S. PATENT DOCUMENTS

| | | | |
|---|---|---|---|
| 4,435,713 | 3/1984 | Gasparaitis et al. | 343/702 |
| 4,867,698 | 9/1989 | Griffiths | 343/702 |
| 5,204,687 | 4/1993 | Elliott et al. | 343/900 |
| 5,479,178 | 12/1995 | Ha | 343/900 |
| 5,594,457 | 1/1997 | Wingo | 343/702 |

FOREIGN PATENT DOCUMENTS 7-038315 2/1995 Japan .

*Primary Examiner*—Michael C. Wimer
*Attorney, Agent, or Firm*—Sughrue, Mion, Zinn, Macpeak & Seas, PLLC

[57] ABSTRACT

The antenna for a radio equipment includes a base portion boot made of a flexible material and secured to an edge of an opening of a support hole in a radio equipment body such that it partially extends outwardly over a predetermined length from the radio equipment body. A flexible pipe is integrally coated on an outer periphery of a portion of a linear antenna element which is positioned in a through-hole of the base portion boot when the linear antenna element is at its retracted position in the radio equipment body.

2 Claims, 5 Drawing Sheets

TELESCOPING, DUAL ANTENNA MOUNTED WITH FLEXIBLE BOOT

This is a Continuation of application Ser. No. 08/497,161 filed Jun. 30, 1995 abandoned.

BACKGROUND OF THE INVENTION

1. Field of the Invention

This invention relates to improvements in or relating to an antenna for use with a small communication equipment such as a portable radio equipment, and more particularly to an antenna for a radio equipment which can eliminate a disadvantage that an end portion of the antenna element is liable to be deformed and damaged or broken by an impact when it drops or in a like accident, because an end portion of an antenna element which can be retracted into the radio equipment is extended from a body of the radio equipment at an antenna accommodated portion.

2. Description of the Related Art

Recently, portable radio equipment which are small in size and light in weight and superior in portability have been widely available. An example of an antenna for use with such portable radio equipment is disclosed in and known from Japanese Patent Laid-Open Application No. Heisei 7-38315. The antenna is shown in FIGS. 1 and 2.

FIG. 1 is a sectional view showing the antenna in a condition in which it is extended from a housing, and FIG. 2 is a sectional view showing the antenna in another condition in which it is retracted in the housing. Referring to FIGS. 1 and 2, reference numeral 1 denotes a housing of the portable radio equipment, and reference numeral 2 denotes an antenna mounted for extending and retracting movement relative to the housing 1. Antenna 2 includes a first coil case 3 provided at an end thereof, and linear antenna element 4 connected to first coil case 3. Coiled antenna element 5 is provided in the inside of first coil case 3 and electrically connected to linear antenna element 4. Large diameter portions 4*a* and 4*b* are formed at the upper and lower ends of linear antenna element 4, and connecting end portion 4*c* is formed at the lower end of linear antenna element 4.

Reference numeral 6 denotes a connecting metal element embedded in housing 1. Whether antenna 2 is in the condition extended from or retracted in housing 1 as shown in FIGS. 1 and 2, respectively, connecting metal element 6 is electrically connected to large diameter portions 4*a* and 4*b* of linear antenna element 4. Further, connecting metal element 6 is connected to circuit board 8 by way of feed line 7 and connected to a radio circuit by way of matching circuit 9.

Reference numeral 10 denotes a second coil case. Second coil case 10 is constituted from a connecting terminal 11 which is electrically connected to the connecting end portion 4*c* of linear antenna element 4 when antenna 2 is retracted in housing 1, and coiled antenna element 12 connected to connecting the terminal 11. The other end of the coiled antenna element 12 is grounded to a grounding plate of circuit board 8 by way of feed line 13.

However, when antenna 2 described above is retracted as shown in FIG. 2, since the first coil case 3 extends outwardly of the radio equipment while first coil case 3 and linear antenna element 4 are coupled rigidly to each other, when an impact acts upon first coil case 3 because of a drop of the radio equipment or collision with an obstacle or by some other cause, large diameter portion 4*a* of linear antenna element 4 directly below first coil case 3 is liable to be deformed and damaged or broken, making a cause of failure.

In a radio equipment which includes an antenna of the conventional structure described above, in order to prevent possible damage to or a break of the end portion of the antenna by an external stress, first coil case 3 must be minimized so as to minimize the extending amount of first coil case 3 when the antenna is retracted. This, however, results in reduction in dimension of coiled antenna element 5 of first coil case 3 and consequently in degradation of the sensitivity characteristic of the antenna in its retracted condition.

SUMMARY OF THE INVENTION

The present invention has been made to solve such problems of the prior art as described above, and it is an object of the present invention to provide an antenna for a radio equipment which can prevent deformation of and damage to an end portion thereof, which extends outwardly from the radio equipment when the antenna is retracted in a body of the radio equipment, by an external stress arising from a rigid structure of the end portion of the antenna and degradation of the sensitivity characteristic arising from a decrease in extending amount of the end portion of the antenna when the antenna is retracted.

In order to attain the object described above, according to the present invention, there is provided an antenna for a radio equipment, comprising a linear antenna element mounted for back and forth movement between a retracted position in which the linear antenna element is retracted in a support hole formed in a radio equipment body and an extended position in which the linear antenna element is extended outwardly from the support hole, a base portion boot made of a flexible material and secured to an edge of an opening of the support hole, the base portion boot having a through-hole through which the linear antenna element extends, and a flexible pipe integrally coated on an outer periphery of a portion of the linear antenna element which is positioned in the through-hole of the base portion boot when the linear antenna element is at the retracted position, the base portion boot partially extending outwardly over a predetermined length from the radio equipment body.

The antenna for a radio equipment may be constructed such that the linear antenna element has at an end portion thereof a coil case which has a built-in coiled antenna element electrically coupled to the linear antenna element, and the coil case is supported by the base portion boot without passing the through-hole of the base portion boot when the linear antenna element is at the retracted position.

With the antenna for a radio equipment of the present invention having the construction described above, when the linear antenna element is retracted in the radio equipment body, the portion of the linear antenna element which is positioned directly below the end portion of the antenna is protected doubly by the flexible pipe and the base portion boot which extends outwardly over the predetermined length from the radio equipment body. Consequently, the portion of the linear antenna element is not damaged by a drop of the radio equipment, collision with an obstacle or a like cause. Further, since the base portion boot partially extends outwardly over the predetermined length from the radio equipment body, the length of the linear antenna element which extends from the radio equipment body is increased as much, which improves the sensitivity characteristic.

The above and other objects, features, and advantages of the present invention will become apparent from the following description referring to the accompanying drawings which illustrate an example of a preferred embodiment of the present invention.

DETAILED DESCRIPTION OF THE PREFERRED EMBODIMENT

An embodiment of the present invention is described below with reference to the drawings.

Figure 1:
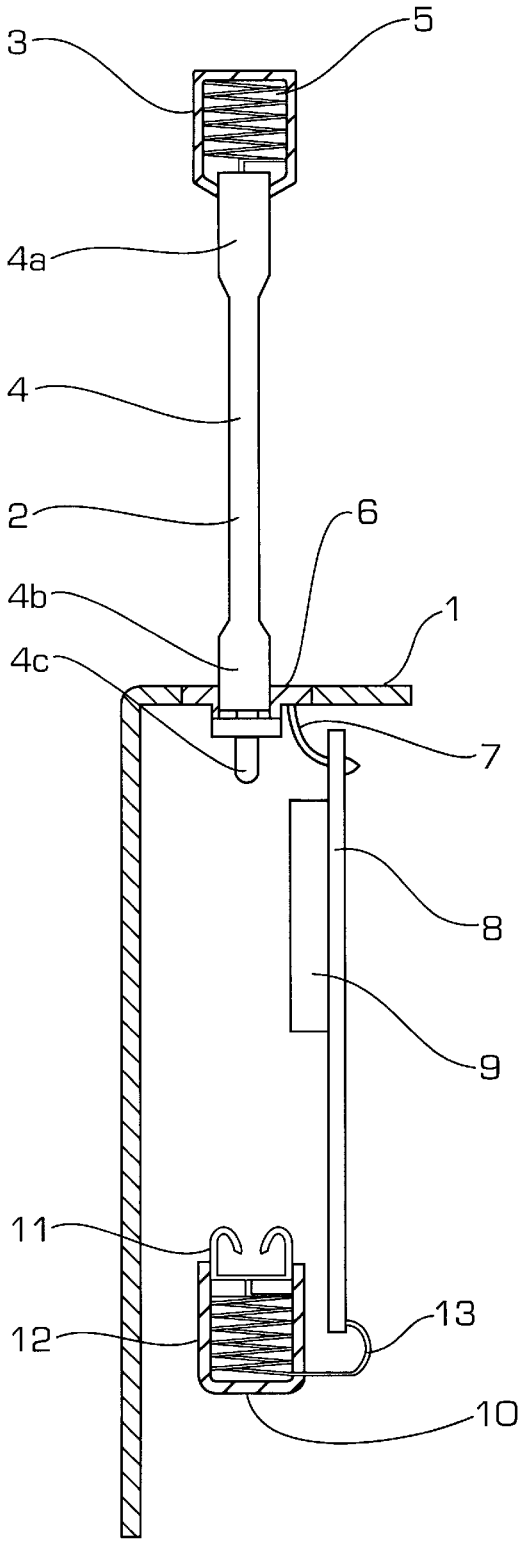
FIG. 1 (PRIOR ART)
FIG. 1 is a sectional view of an antenna according to the prior art in an extended condition.
Figure 2:
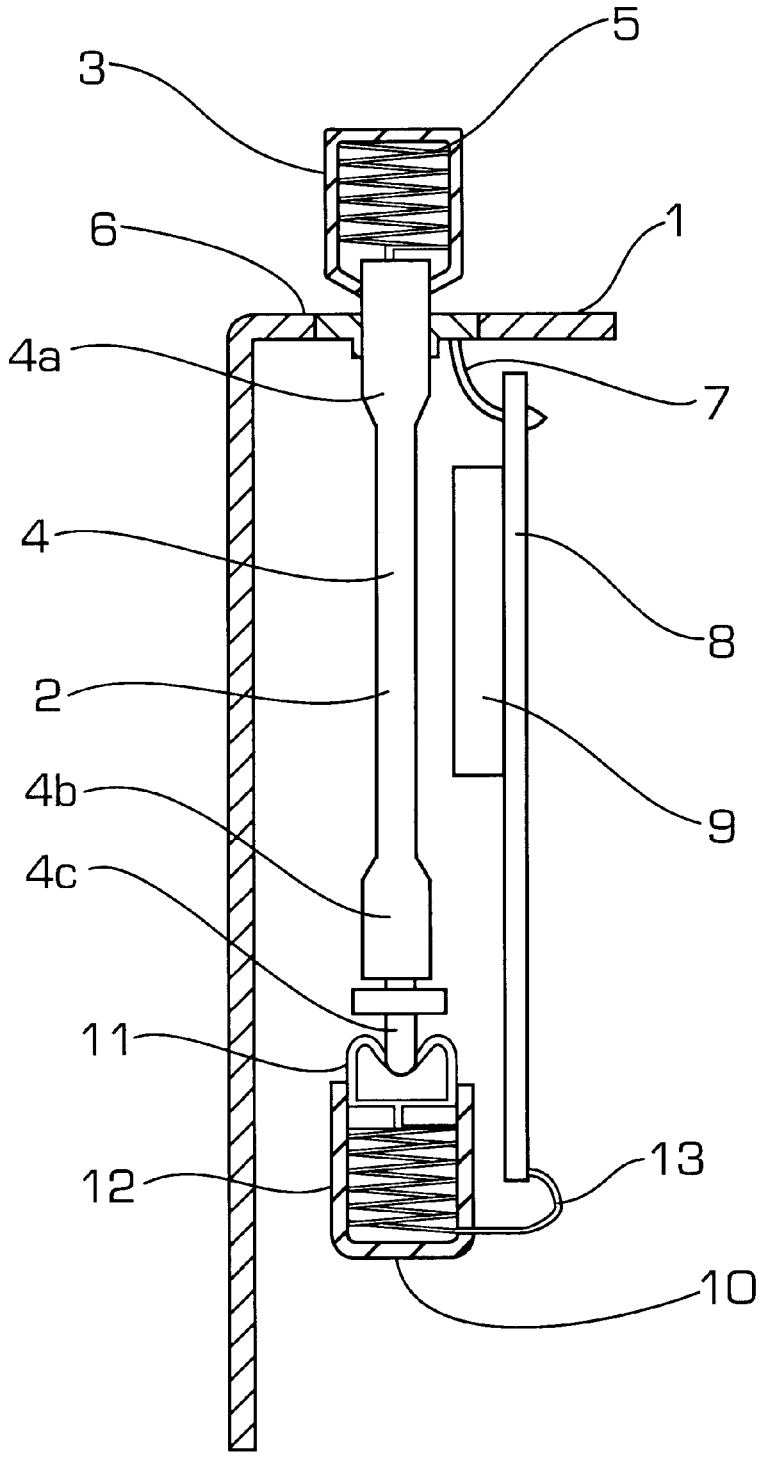
FIG. 2 (PRIOR ART)
FIG. 2 is a sectional view of the antenna according to the prior art in a retracted condition.
Figure 3:
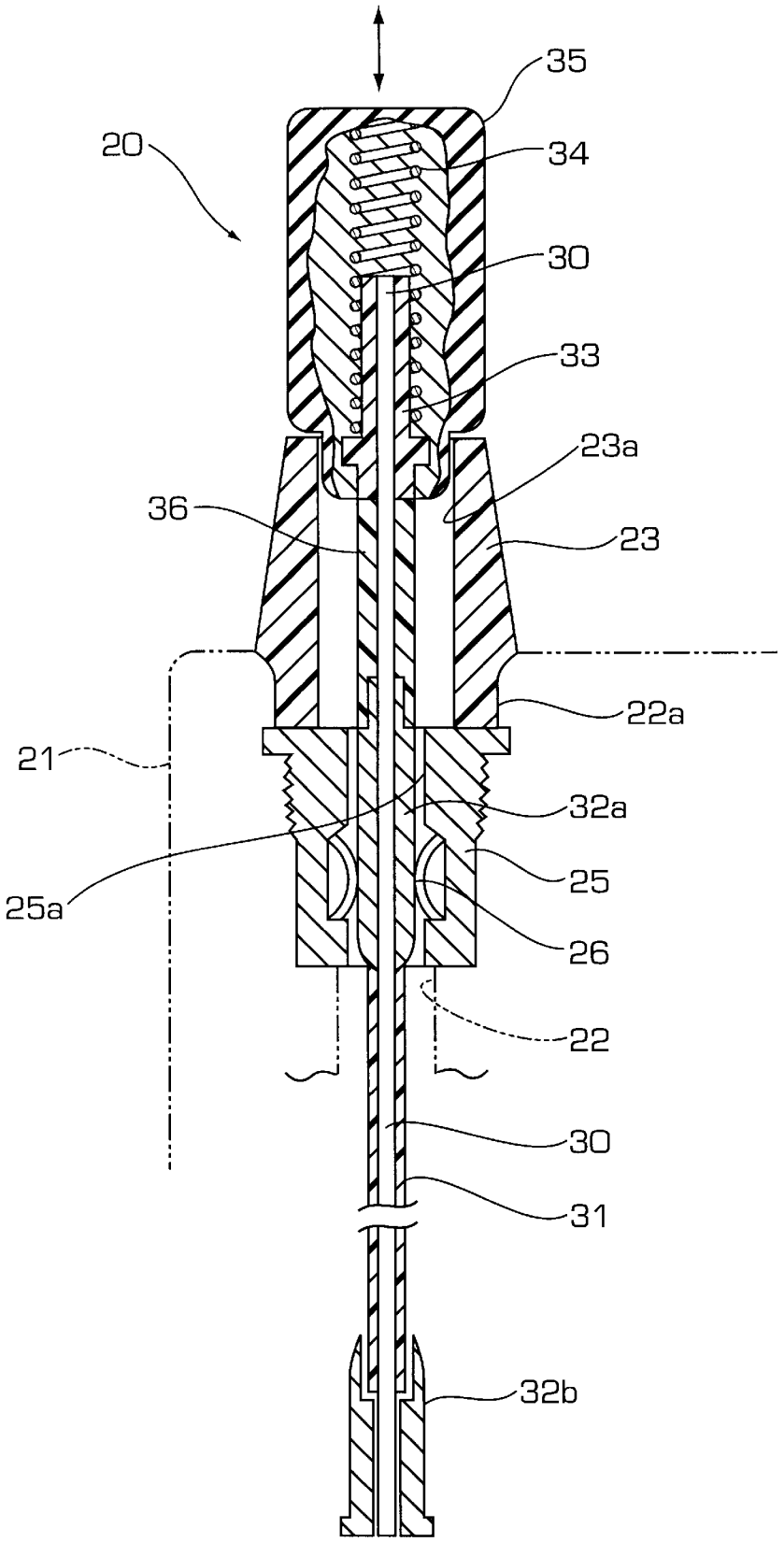
FIG. 3 is a sectional view showing the construction of an embodiment of an antenna for a radio equipment of the present invention.

FIG. 3 is a sectional view showing the construction of an embodiment of an antenna for a radio equipment of the present invention when the antenna is in a retracted condition. Antenna 20 shown in FIG. 3 is supported for movement in axial directions (directions indicated by a double-sided arrow mark in FIG. 3) into and out of radio equipment body 21 through support hole 22 formed in radio equipment body 21. Base portion metal member 25 is embedded in an inner wall of the opening of support hole 22 with a predetermined depth from the top face of radio equipment body 21. A portion 22*a* of support hole 22 in the proximity of the opening end thereof is expanded a little in diameter, and base portion boot 23 made of a material having a suitable flexibility such as an elastomer resin of polyester is coaxially integrated with large diameter portion 22*a*.

Base portion boot 23 is a tubular member having through-hole 23*a* formed therein which extends in an axial direction therethrough. A lower end portion of the base portion boot 23 is secured to base portion metal member 25 while the other portion of base portion boot 23, from a central portion in the axial direction to the upper end thereof, extends upwardly from the top face of radio equipment body 21. Through-hole 25*a* of base portion metal member 25 and through-hole 23*a* of base portion boot 23 are communicated with each other, and the antenna 20 is fitted in and supported by through-holes 25*a* and 23*a*.

A spring 26, which serves as resilient means for fixedly positioning the antenna at a retracted position and an extended position, is provided on an inner periphery of the base portion metal member 25. In particular, spring 26 which is engaged with an upper metal coating member 32*a*, and lower metal coating member 32*b*, which will be hereinafter described, together hold antenna 1 at the retracted position and the extended position, respectively. Further, the spring 26 and the base portion metal member 25 are made of a conductive metal and serve as feeding means.

Antenna 20 includes a coil case 35 including linear antenna element 30 made of a Ni—Ti alloy and superior in flexibility and strength. Insulating tube 31 and the pair of metal coating members 32*a* and 32*b* are integrally coated on an outer periphery of a linear antenna element 30. Insert metal member 33 is integrally coated at an upper end portion of linear antenna element 30, and coiled antenna element 34 is wound around the upper end portion of linear antenna element 30. Further, the insert metal member 33 and the coiled antenna element 34 are integrated with each other by molding a resin to form a coil case 35. It is to be noted that, instead of integrating the insert metal member 33 and the coiled antenna element 34 by molding a resin, they may be merely surrounded by hollow plastic case 35. The linear antenna element 30 and coiled antenna element 34 are electrically coupled to each other by capacitive coupling. Further, the coil case 35 is so shaped that, when the linear antenna element 30 is in its retracted position, the coil case 35 is supported on the base portion boot 23 without passing through the through-hole 23*a* of the base portion boot 23.

It is to be noted that a flexible pipe 36 made of a flexible resin is integrally coated on an outer periphery of the linear antenna element 30 positioned between upper metal coating member 32*a* and insert metal member 33. In particular, the flexible pipe 36 is coated on the outer periphery of a portion of the linear antenna element 30 which is positioned within through-hole 23*a* of base portion boot 23 described above when antenna 20 is in such a retracted condition, as shown in FIG. 3. In addition, upper and lower end portions of the flexible pipe 36 are integrated with the coil case 35 and the upper metal coating member 32*a*, respectively. As a result, when antenna 20 is in a retracted condition, the portion of linear antenna element 30 which is positioned immediately below coil case 35 is protected doubly by base portion boot 23 and flexible pipe 36. This increases the strength of an end portion of the antenna which extends outwardly from radio equipment body 21 in its retracted condition against an external stress, and also can increase the length of a portion of the antenna which extends outwardly from radio equipment body 21 to raise the sensitivity characteristic.

It is to be noted that the flexible pipe 36 may be coated not only at the portion of the linear antenna element 30 described above but also at some other portion of the linear antenna element 30 such as, for example, a portion between the upper and lower metal coating members 32*a* and 32*b*.

Figure 4:
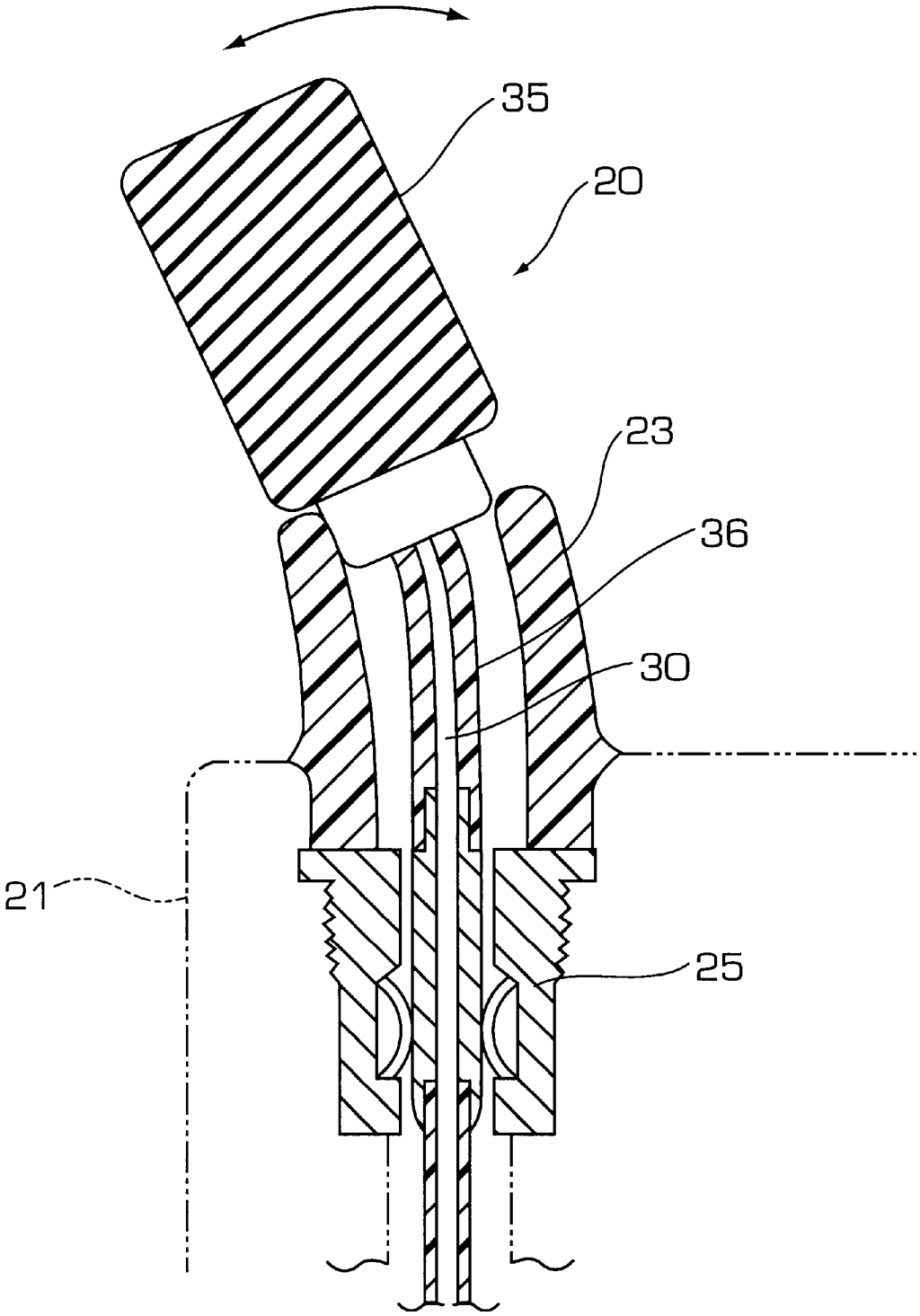
FIG. 4 is a partial sectional view illustrating a deformed condition of the antenna of the present invention when an external force is applied to the antenna in its retracted position.

FIG. 4 shows the antenna 20 in a condition wherein it is deformed by an external force applied to the coil case 35 at the end portion thereof when it is in its retracted position. Since the impact is absorbed and attenuated doubly by the base portion boot 23 and the flexible pipe 36, no damage is provided to the linear antenna element 30 in the inside of the antenna 20. Consequently, even if the coiled antenna element is increased in size to increase the outwardly extending amount of it, the possibility of failure is reduced, and consequently, the sensitivity of it can be improved.

Figure 5:
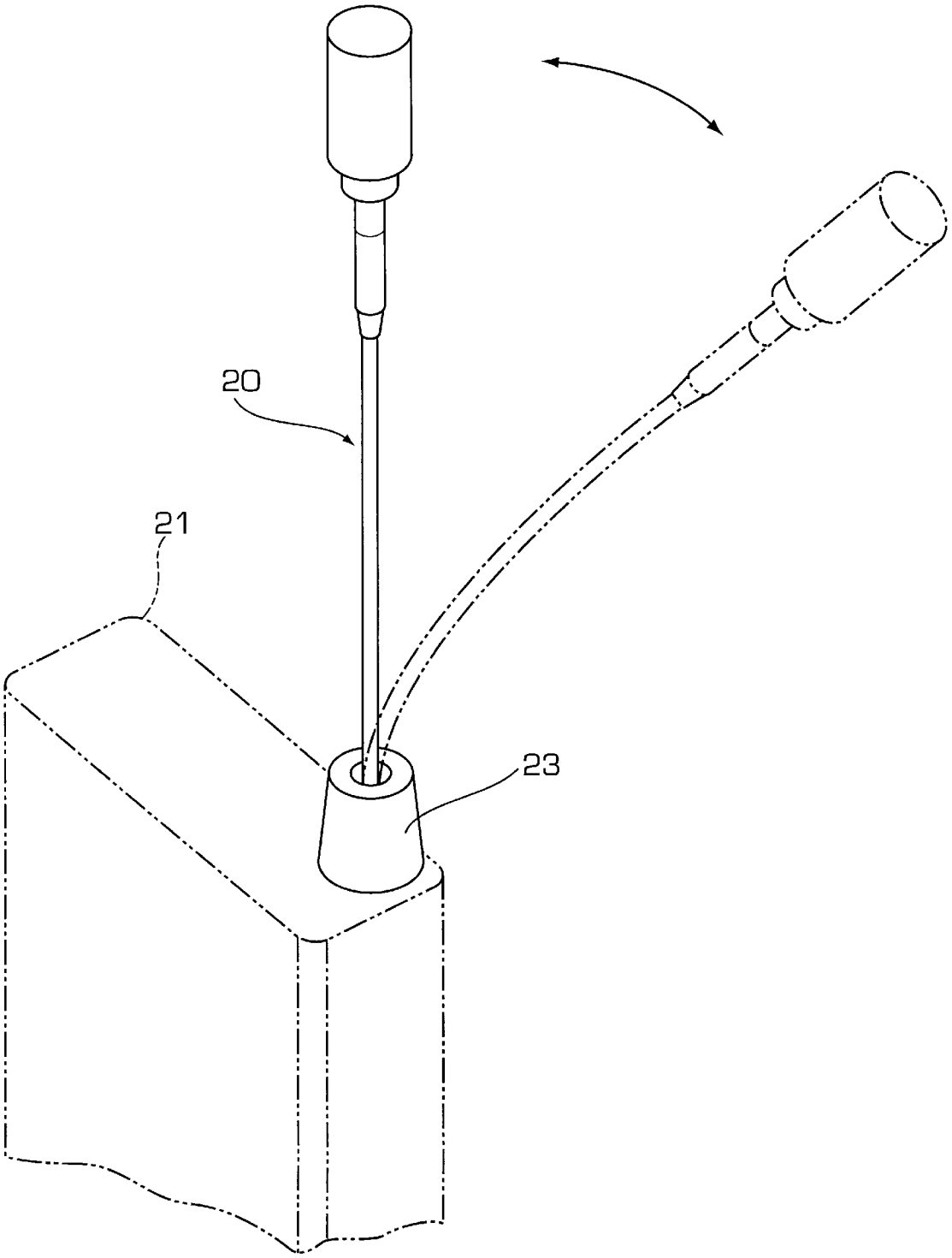
FIG. 5 is a schematic perspective view illustrating a deformed condition of the antenna of the present invention when an external force is applied to the antenna in its extended position.

FIG. 5 shows the antenna 20 of the present invention in a deformed condition when it is extended. Also in this instance, since the lower end portion of the antenna 20 is supported by base portion boot 23 made of a flexible material, most of the stress caused by the deformation is absorbed and attenuated by base portion boot 23. Consequently, even if antenna 20 is deformed by a great amount as seen in FIG. 5, the lower portion of linear antenna element 30 will not be damaged nor degraded in mechanical strength.

As described above, with regard to the antenna for a radio equipment of the present invention, since it includes a base portion boot made of a flexible material and secured to an edge of an opening of a support hole in a body of the radio equipment such that it partially extends outwardly over a predetermined length from the radio equipment body, and a flexible pipe integrally coated on an outer periphery of a portion of a linear antenna element which is positioned in a through-hole of the base portion boot when the linear antenna element is at its retracted position in the radio equipment body, a portion in the proximity of the upper end of the antenna is protected by a dual impact attenuating structure of the base portion boot and the flexible pipe when the linear antenna element is at the retracted position. Consequently, an impact to be applied to the end portion of the antenna can be absorbed and attenuated by the dual impact attenuating structure.

Further, since the strength of the end portion of the antenna against an external stress is increased, the extended amount of an antenna case including a coiled antenna element when the antenna is retracted can be increased as much, and consequently, the sensitivity characteristic can be increased.

It is to be understood that variations and modifications of the antenna for radio equipment disclosed herein will be evident to those skilled in the art. It is intended that all such modifications and variations be included within the scope of the appended claims.

What is claimed is:

1. An antenna for radio equipment, comprising:

a linear antenna element mounted for back and forth movement between a retracted position in which said linear antenna element is retracted in a support hole formed in a radio equipment body and an extended position in which said linear antenna element is extended outwardly from said support hole;

a coil case provided around an upper end portion of said linear antenna element, having a built-in coiled antenna element electrically coupled to said linear antenna element in said retracted and said extended positions;

a flexible boot made of an elastomer material and secured to an edge of an opening of said support hole so as to extend outwardly from said radio equipment body, having a through-hole through which said linear antenna element extends, said flexible boot supporting without passing said coil case through said through-hole so as to extend said linear antenna element outwardly from said retracted position when said linear antenna element is moved to said support hole;

a flexible pipe coated on an outer periphery of a portion of said linear antenna element which is positioned in said through-hole of said flexible boot when said coil case is supported by said flexible boot.

2. An antenna for radio equipment, comprising:

a linear antenna element mounted for back and forth movement between a retracted position in which said linear antenna element is retracted in a support hole formed in a radio equipment body and an extended position in which said linear antenna element is extended outwardly from said support hole;

a coil case provided around an upper end portion of said linear antenna element, having a built-in coiled antenna element electrically coupled to said linear antenna element by capacitive coupling;

a flexible boot made of an elastomer material and secured to an edge of an opening of said support hole so as to extend outwardly from said radio equipment body, having a through-hole through which said linear antenna element extends, said flexible boot supporting without passing said coil case through said through-hole so as to extend said linear antenna element outwardly from said retracted position when said linear antenna element is moved to said support hole;

a flexible pipe coated on an outer periphery of a portion of said linear antenna element which is positioned in said through-hole of said flexible boot when said coil case is supported by said flexible boot.

* * * * *